US010460593B2

(12) United States Patent
Obaidi et al.

(10) Patent No.: US 10,460,593 B2
(45) **Date of Patent: *Oct. 29, 2019**

(54) DYNAMIC DETERMINATION OF A GEOGRAPHICALLY DISPERSED GROUP FOR ALERT RESOLUTION

(71) Applicant: T-Mobile USA, Inc., Bellevue, WA (US)

(72) Inventors: Ahmad Arash Obaidi, Issaquah, WA (US); Eric W. Yocam, Sammamish, WA (US); Michael Mosher, Seattle, WA (US)

(73) Assignee: T-Mobile USA, Inc., Bellevue, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/265,822

(22) Filed: Feb. 1, 2019

(65) Prior Publication Data

US 2019/0188996 A1 Jun. 20, 2019

Related U.S. Application Data

(60) Continuation of application No. 15/783,696, filed on Oct. 13, 2017, now Pat. No. 10,198,933, which is a division of application No. 14/451,295, filed on Aug. 4, 2014, now Pat. No. 9,824,576.

(51) Int. Cl.
*G08B 27/00* (2006.01)
*G08B 25/00* (2006.01)

(52) U.S. Cl.
CPC ..... *G08B 27/005* (2013.01); *G08B 25/005* (2013.01); *G08B 25/006* (2013.01); *G08B 27/006* (2013.01)

(58) Field of Classification Search
CPC ..... G06Q 10/00; H04W 4/00
See application file for complete search history.

(56) References Cited

U.S. PATENT DOCUMENTS

2006/0085419 A1* 4/2006 Rosen ..... G06Q 30/02
2007/0194938 A1* 8/2007 Mitchell ..... A62B 99/00 340/573.1
2009/0102644 A1* 4/2009 Hayden ..... G08B 27/003 340/540

(Continued)

OTHER PUBLICATIONS

Office Action for U.S. Appl. No. 15/783,696, dated Feb. 22, 2018, Obaidi, "Dynamic Determination of a Geographically Dispersed Group for Alert Resolution", 16 pages.

(Continued)

*Primary Examiner* — Shirley Lu
(74) *Attorney, Agent, or Firm* — Lee & Hayes, P.C.

(57) ABSTRACT

Described herein are techniques for receiving an alert associated with an entity and dynamically determining, based on the alert and on substantially real-time attributes for the entity, a geographically dispersed group in which each member of the geographically dispersed group either is a device associated with the entity or shares at least one attribute with the entity. The techniques further include requesting information about the entity from the geographically dispersed group, receiving information from at least a subset of the group, and taking action responsive to the alert based on the received information.

20 Claims, 6 Drawing Sheets

(56) References Cited

U.S. PATENT DOCUMENTS

| | | | |
|---|---|---|---|
| 2016/0035215 | A1 | 2/2016 | Obaidi et al. |
| 2018/0040233 | A1 | 2/2018 | Obaidi et al. |

OTHER PUBLICATIONS

Office action for U.S. Appl. No. 14/451,295, dated Mar. 22, 2017, Obaidi, "Dynamic Determination of a Geographically Dispersed Group for Alert Resolution", 12 pages.
Office Action for U.S. Appl. No. 15/783,696, dated Jul. 11, 2018, Obaidi, "Dynamic Determination of a Geographically Dispersed Group for Alert Resolution", 8 pages.

* cited by examiner

DYNAMIC DETERMINATION OF A GEOGRAPHICALLY DISPERSED GROUP FOR ALERT RESOLUTION

CROSS REFERENCE TO RELATED APPLICATIONS

This application is a continuation of U.S. patent application Ser. No. 15/783,696, filed Oct. 13, 2017, which is a divisional application of U.S. patent application Ser. No. 14/451,295, filed Aug. 4, 2014, both of which are fully incorporated herein by reference.

BACKGROUND

The world is increasingly filled with devices connected to the Internet. No longer are such devices limited to desktop computers and laptops, or even smart phones; wearable devices and even traditional appliances are now Internet-connected. This increasing variety of devices is also more and more capable of capturing information about their surrounds, such as their own locations and even the movement of people in their vicinity. This information is then shared with a number of entities, whether governments or advertisers, for commercial or public safety purposes.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

The disclosure describes herein techniques for dynamically determining a geographically dispersed group of persons and devices to resolve alerts. Alerts may be received for any number of circumstances. For example, alerts may indicate that a person's device might have been stolen, that child might be unsafe, or that access has been requested to a facility or computer network. Resolution of these different types of alerts may call for different groups. For example, resolution of an alert associated with a child may call for a teacher and parent, while access to a floor of a building may call for a person working on that floor and someone proximate to the person seeking the access. Further, real-time data may also call for different groups. For example, if one of a person's devices indicates that a person is in Cleveland and another device indicates that the person is in Seattle, different people may be contacted to vouch for the current location of the person depending on when the alert is generated.

Overview

Figure 1:
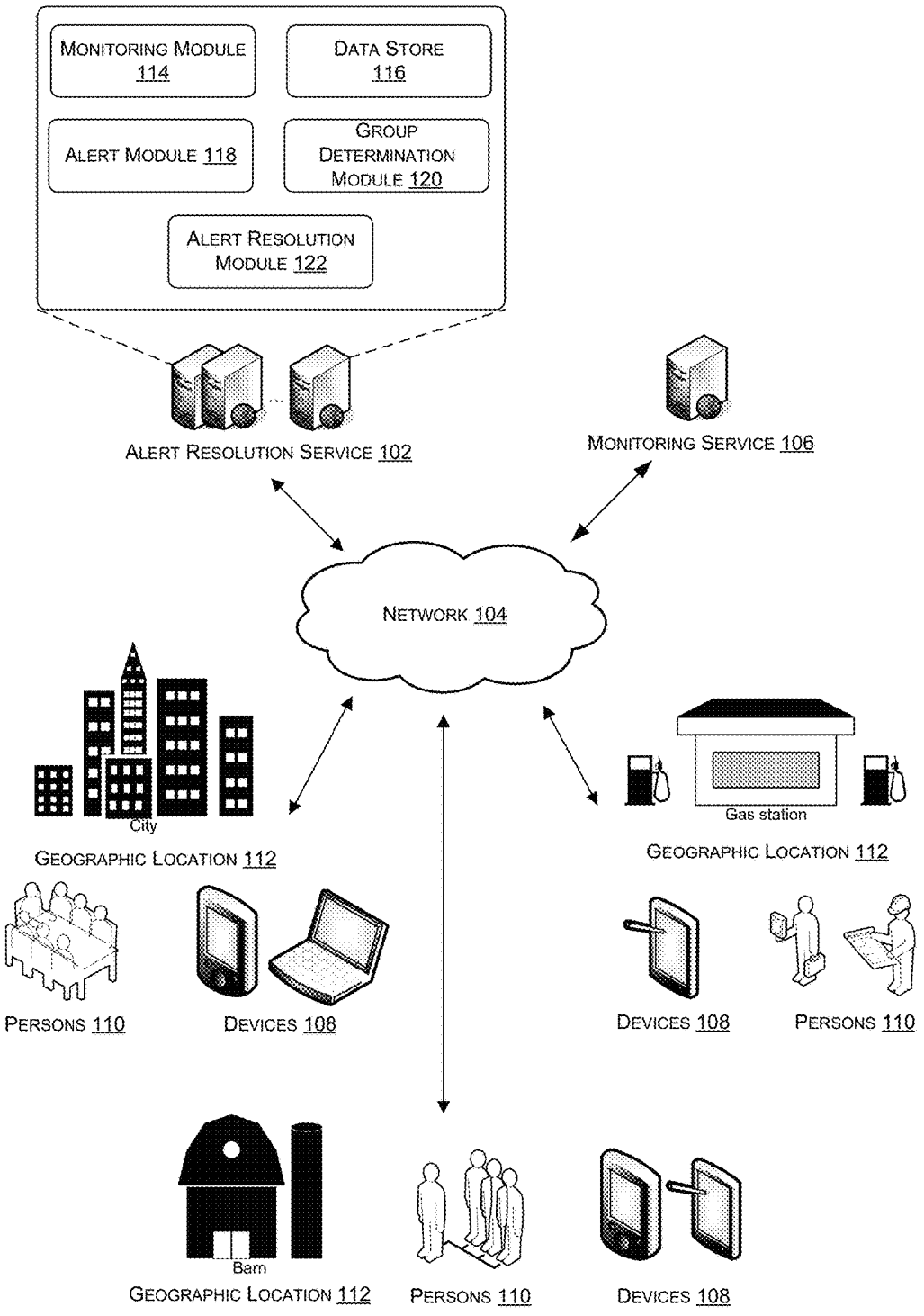
FIG. 1 illustrates an overview of one or more devices and data store(s) that are programmed to determine a geographically dispersed group of persons sharing attributes with another person to resolve an alert associated with that other person.

FIG. 1 illustrates an overview of one or more devices and data store(s) that are programmed to determine a geographically dispersed group of persons sharing attributes with another person to resolve an alert associated with that other person. As illustrated, an alert resolution service 102 may receive alerts or collect information over a network 104. The alert resolution service 102 may receive alerts from a monitoring service 106. Also or instead, the alert resolution service 102 may collect information from devices 108 of persons 110, who may be at a variety of geographic locations 112. The alert resolution service 102 may include a monitoring module 114 to collect information about devices 108 and persons 110, a data store 116 to store attributes of persons 110 in data profiles, an alert module 118 to generate or receive alerts, a group determination module 120 to dynamically determine a group to resolve a received or generated alert, and an alert resolution module 122 to communicate with members of the group and take action based on those communications.

Figure 6:
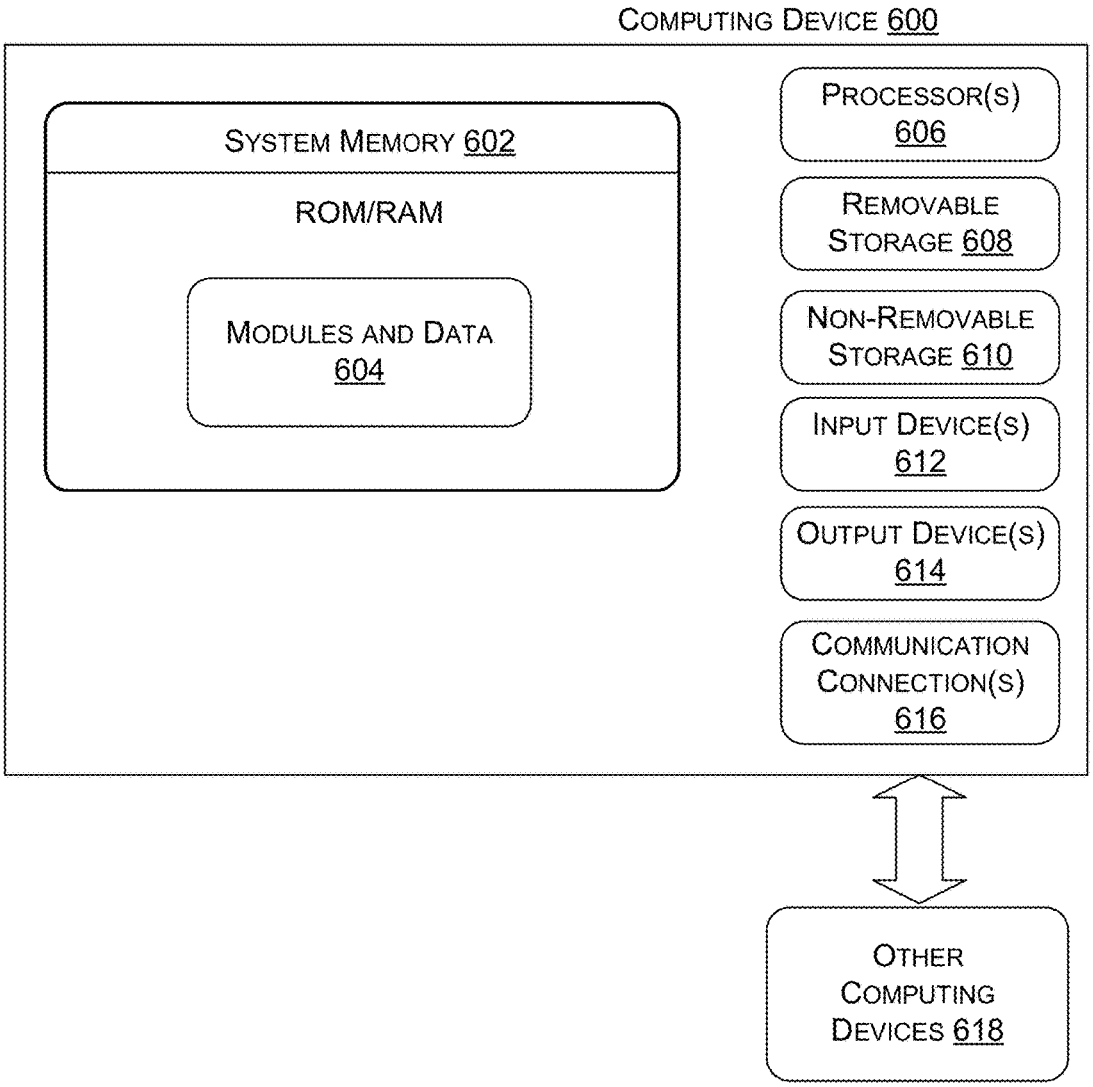
FIG. 6 illustrates an example system architecture of a computing device configured to perform all or part of the dynamic determination of the geographically dispersed group.

In various implementations, the alert resolution service 102 may include one or more computing devices, such as personal computers (PCs), laptops, work stations, desktop computers, server devices, server farms, main frames, etc. For example, the alert resolution service 102 may comprise a cloud computing network of devices. Alternatively or additionally, the alert resolution service 102 may comprise a virtual machine on a single device or virtual machines on multiple devices. An example computing device of the alert resolution service 102 is illustrated in FIG. 6 and is described below with reference to that figure.

The alert resolution service 102 may belong to a core network of a telecommunication service provider, may be a separate service which receives information over a telecommunication network of a telecommunication service provider, or may simply be a service access over a data network. The alert resolution service 102 may either generate or receive alerts—or both—and may resolve those alerts by determining and utilizing a group of persons and devices. For example, alerts may indicate that a device has been stolen, and the alert resolution service 102 may determine a group of persons and devices to resolve the alert. Such a group could include other devices of the owner of the device in question, family members of the owner, the owner himself or herself, and persons at the location where the device is expected to be. After determining the group, the devices could be contacted for their current locations and the persons could be asked about the current location of the owner of the device. If the devices and persons indicate that the owner is at the current location of the potentially stolen device, no further action is taken. If, on the other hand, the device is in a different location from the other devices and from the owner, the owner may be alerted that the device may be stolen, and authorities may be contacted. Determination of these groups may be based on substantially real-time information, such as real-time locations, that may be collected by the alert resolution service 102 from multiple devices 108 of persons 110.

In various implementations, the network 104 connecting the alert resolution service 102, the monitoring service 106, and the devices 108 may include any one or more wired or wireless networks. The network 104 may include a network of a telecommunication service provider and/or other public networks, private networks, or both. The network 104 may also include circuit-switched networks, packet-switched networks, or both. Further, the network 104 may include cellular network(s), wireless network(s) (e.g., WiFi, WiMax, etc.), or both.

It should also be appreciated that the network 104 could be configured to employ any combination of common wireless broadband communication technologies, including, but not limited to, Long Term Evolution (LTE)/LTE Advanced technology, High-Speed Data Packet Access (HSDPA)/Evolved High-Speed Packet Access (HSPA+) technology, Universal Mobile Telecommunications System (UMTS) technology, Code Division Multiple Access (CDMA) technology, Global System for Mobile Communications (GSM) technology, WiMax technology, or WiFi technology. Further, a backhaul portion of the network 104 may be configured to employ any common wireline communication technology, including but not limited to, optical fiber, coaxial cable, twisted pair cable, Ethernet cable, and power-line cable, along with any common wireless communication technology, such as those described above.

In various implementations, the monitoring service 106 may collect information from devices 108 or receive collected information from the alert resolution service 102 or another source. The monitoring service 106 may then determine whether to generate an alert and may provide the alert to the alert resolution service 102. The functionality of the monitoring service 106 may be similar to that of the monitoring module 114 and alert module 118, which are described below in greater detail.

In further implementations, the devices 108 of the persons 110 at the various geographic locations 112 may comprise any sort of devices. For example, devices 108 may include cellular phones, smart phones, tablet computers, PCs, laptop computers, electronic readers, media players, gaming devices, etc. Devices 108 may also include wearable computing devices, such as watches, wristbands, etc., which may connect to the network 104 either directly or through another adjacent device 108 of the person wearing the device 108. A given person 110 may have one or more device 108, and multiple devices 108 of a person 110 may be located at multiple different geographic locations 112 (e.g., a watch 108 may be left at home while a person 110 goes to a workplace 112 with her smart phone 110). These devices 108 may periodically communicate their locations 112 or other information to the alert resolution service 102, the monitoring service 106, or some other data store.

In various implementations, the alert resolution service 102 may be configured with a monitoring module 114 to collect information and update a data store 116 in substantially real-time. The monitoring module 114 may retrieve information from devices 108 and from a number of sources. Each person 110 may be associated with a data profile stored in the data store 116, which may in turn be associated with a registration for one or more services, such as services of a telecommunication service provider. Each data profile may include a name of the person 110, a home address, a work address, a phone number, a telecommunication service plan identifier, an employer, an employment role, links to other persons (e.g., spouses and children) which identify the type of the relation (e.g., familial role), usernames of accounts of the person 110, devices 108 of the person 110, characteristics of the devices 108, and substantially real-time locations 112 (e.g., global positioning system (GPS) data) of the devices 108. These data profiles may be constructed as part of a service registration or at a different time. The monitoring module 114 may access the data profiles to identify the devices 108 and use the information about the devices 108 stored in the data profiles to contacts the devices 108. Upon contacting the devices 108, the monitoring module 114 may receive locations 112 or other information and may perform either or both of updating the data profiles or building histories of models for the devices 108, persons 110, or both.

The data store 116 may represent any one or more data stores and may store at least the above-described data profiles. The data store 116 may also store histories or models constructed by the monitoring module 114. In some implementations, the data store 116 may comprise any one or more databases, files, storage structures, etc.

In further implementations, the alert module 118 of the alert resolution service 102 may utilize rules, thresholds, or models to determine whether information collected by the monitoring module 114 should result in an alert. For example, the alert module 118 may utilize a rule which specifies that the alert module 118 should generate an alert when devices 108 of a sex offender and child are at substantially the same location 112 at substantially the same time. In another example the alert module 118 may generate an alert when the current location 112 of a device 108 differs from a location 112 expected based on the histories or models. Other examples include security considerations associated with the substantially real-time location 112 of the device 108, multiple devices 108 of the person 110 being in different locations 112 at a same time, or a request by the person 110 for some access or activity. Any number of different rules, models, and thresholds may be utilizes by the alert module 118, and these different rules, models, and thresholds may in turn be associated with different sets of rules, models and thresholds for determining groups. In other implementations, rather than generating alerts, the alert module 118 may receive alerts from other sources, such as from the monitoring service 106.

Upon generating an alert or receiving an alert, the alert resolution service 102 may invoke its group determination module 120 to dynamically determine a group of persons 110, devices 108, or both to resolve the alert. The group may be geographically dispersed and determined based on substantially real-time information. Upon being invoked, the group determination module 120 may determine the device 108 or person 110 associated with the alert and retrieve attributes from a data profile for the device 108 or person 110 from the data store 116. The group determination module 120 may then identify persons 110 or devices 108 with matching or related attributes (e.g., person 110 who have same last name, persons 110 who have same employer, persons 110 at a same location 112, etc.). Because some attributes may change over time (e.g., location 112), the identified persons 110 or devices 108 may also be different at different times. Alternatively or additionally, the group determination module 120 may identify other devices 108 of the person 110 associated with the alert. The group determination module 120 may then select a subset of the persons 110 or devices 108 as members of the group.

In some implementations, the group determination module 120 may select the subset of the identified persons 110 or devices 108 based on rules, thresholds, or models. Such rules, thresholds, or models may, for instance, be specific to a type of an alert, to circumstances associated with an alert, or to a location 112. Thus, groups may be selected for a device 108 or person 110 to resolve different alerts. For instance, different groups may be needed to determine if a device 108 is stolen that to determine whether its owner 110 should be allowed to access a facility. Different rules, thresholds, or models for those different alerts would lead to the selection of the different groups by the group determination module 120.

In further implementations, the group determination module 120 may score each identified person 110 or device 108 and select the devices 108 and persons 110 whose score exceeds a threshold as members of the group. For instance, a person 110 or device 108 may receive a point for each attribute shared with the person 110 or device 108 that is associated with the alert. The group determination module 120 may assign these points and calculate the score for a person 110 or device 108 as the sum of its points.

In various implementations, once the group has been determined, an alert resolution module 122 of the alert resolution service 102 may contact the members of the group. For devices 108 that are members of the group, the alert resolution module 122 may request information such as a current location 112 or other environmental information, such as motion data, voice data, video, etc. For persons 110 that are members of the group, the alert resolution module 122 may contact the persons 110 through text messages, multi-media messages, emails, or placing calls. The alert resolution module 122 may include a request for information in the message or call, such as asking whether a person 110 is at a specific location 112, asking whether the person 110 is supposed to be with another person (e.g., a non-custodial parent), asking whether a person 110 should have access to a facility, etc. The contents of the message or call may vary with the type or circumstances of the alert.

The alert resolution module 122 may then receive information from all or a subset of the members of the group and may take action based on the received information. For instance, if the devices 108 for a person 110 are all at a same location 112, the alert resolution module 122 may dismiss the alert even if the current location 112 of the devices 108 is an unusual location 112. In another example, if the received information indicated that a person 110 should not receive access to a facility, the alert resolution module 122 may instruct a system to deny access to the person 110. The action taken or instructed by the alert resolution module 122 may vary with the type of the alert, the circumstances of the alert, the information received, or any combination thereof. Other example actions include authorizing a person 110 to have access, alerting a person 110 that the device 108 of the person 110 has been stolen, alerting authorities regarding a location 112 of a person 110, contacting a parent or guardian regarding the location 112 of a person 110, disabling one or more features of the device 108 of the person 110.

Example Scenarios

Figure 2:
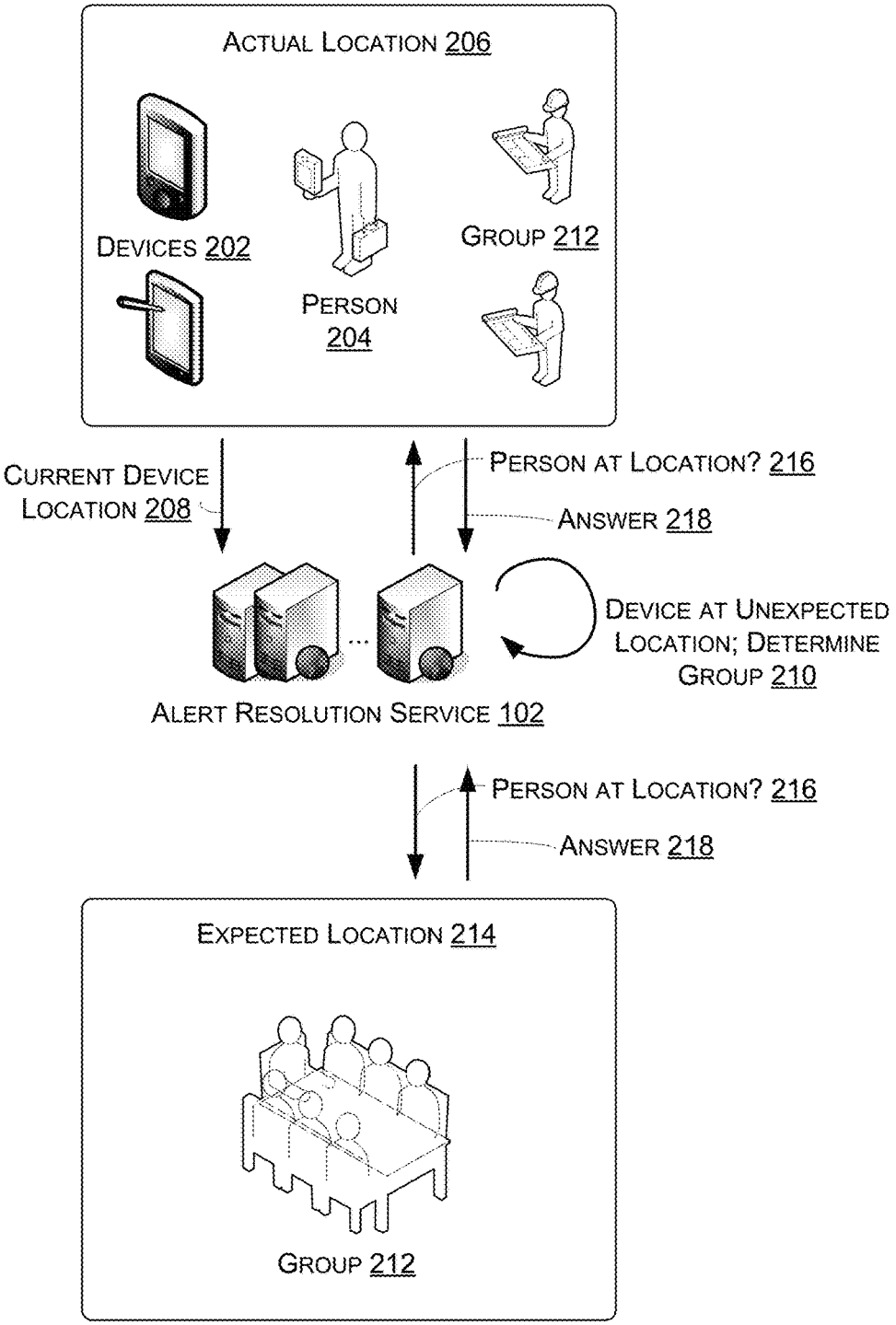
FIG. 2 illustrates an example scenario in which a device of a person appears in an unexpected location and other persons or devices are contacted to ascertain the current location of the person.

FIG. 2 illustrates an example scenario in which a device of a person appears in an unexpected location and other persons or devices are contacted to ascertain the current location of the person. As illustrated, a device 202 of a person 204 may be at a location 206. The device 202 may report 208 its location to the alert resolution service 102. The alert resolution service 102 may determine 210 that the device 202 is not where it would be expected to be in view of the history of its movements and may generate an alert. The alert resolution service 102 may then determine 210 a group 212 which includes persons 212 at the same location as the device 202, persons 212 at the expected location 214 of the device 202, and other devices 202 of the person 204. The alert resolution service 102 may then request 216 information from the group 212, asking whether the person 204 is also at the location 206 (or, in the alternative, asking whether the person 204 is at the expected location 214. The alert resolution service 102 may then receive 218 answers to those questions and take action based on the answers. In the illustrated example, the answers may indicate that the person 204 and device 202 are at the same location 206, which may lead the alert resolution service 102 to conclude that the alert is a false alarm and dismiss the alert. For example, the devices 202 of the person 204 may indicate that all (or some number of them) are at the location 206, which may lead the alert resolution service 102 to conclude that the person 204 is at the location 206.

Figure 3:
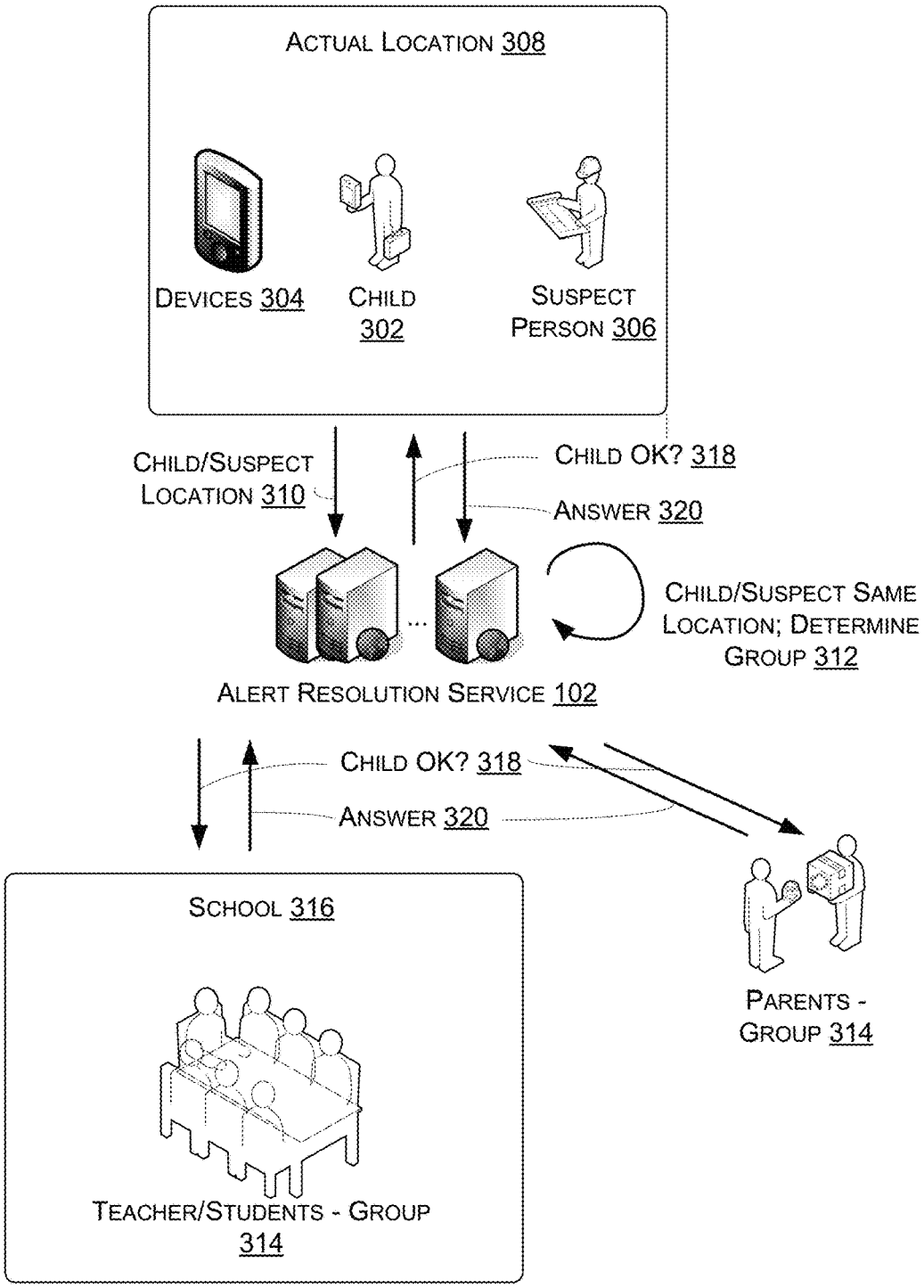
FIG. 3 illustrates an example scenario in which a child appears in an unexpected location or with an unexpected person and in which other persons or devices are contacted to ascertain the appropriateness of the child's location or company.

FIG. 3 illustrates an example scenario in which a child appears in an unexpected location or with an unexpected person and in which other persons or devices are contacted to ascertain the appropriateness of the child's location or company. As illustrated, a child 302 and her device 304 may be with a suspect person 306 (e.g., predator or non-custodial parent) at a same location 308. The device 304 and a device of the suspect person 306 may report 310 their location to the alert resolution service 102. The alert resolution service 102 may determine 312 that the child 302 and suspect person 306 are at the same location 308 and may generate an alert. The alert resolution service 102 may then determine 312 a group 314 which includes a parent or guardian 314 of the child 302 and a teacher or others 314 at a school 316 of the child 302. The alert resolution service 102 may then request 318 information from the group 314, asking whether the child 302 is supposed to be with the suspect person 306, is supposed to be at the location 308, is supposed to be at school 316, etc. The alert resolution service 102 may then receive 320 answers to those questions and take action based on the answers. In the illustrated example, the answers may indicate that the child 302 and suspect person 306 are at the same location 208 (e.g., non-custodial parent is supposed to be with child 302), which may lead the alert resolution service 102 to conclude that the alert is a false alarm and dismiss the alert. Alternatively, the answers may indicate that the child 302 is supposed to be at school 316, which may result in the alert resolution service 102 sending a warning to the parent/guardian 314 or notifying authorities.

Figure 4:
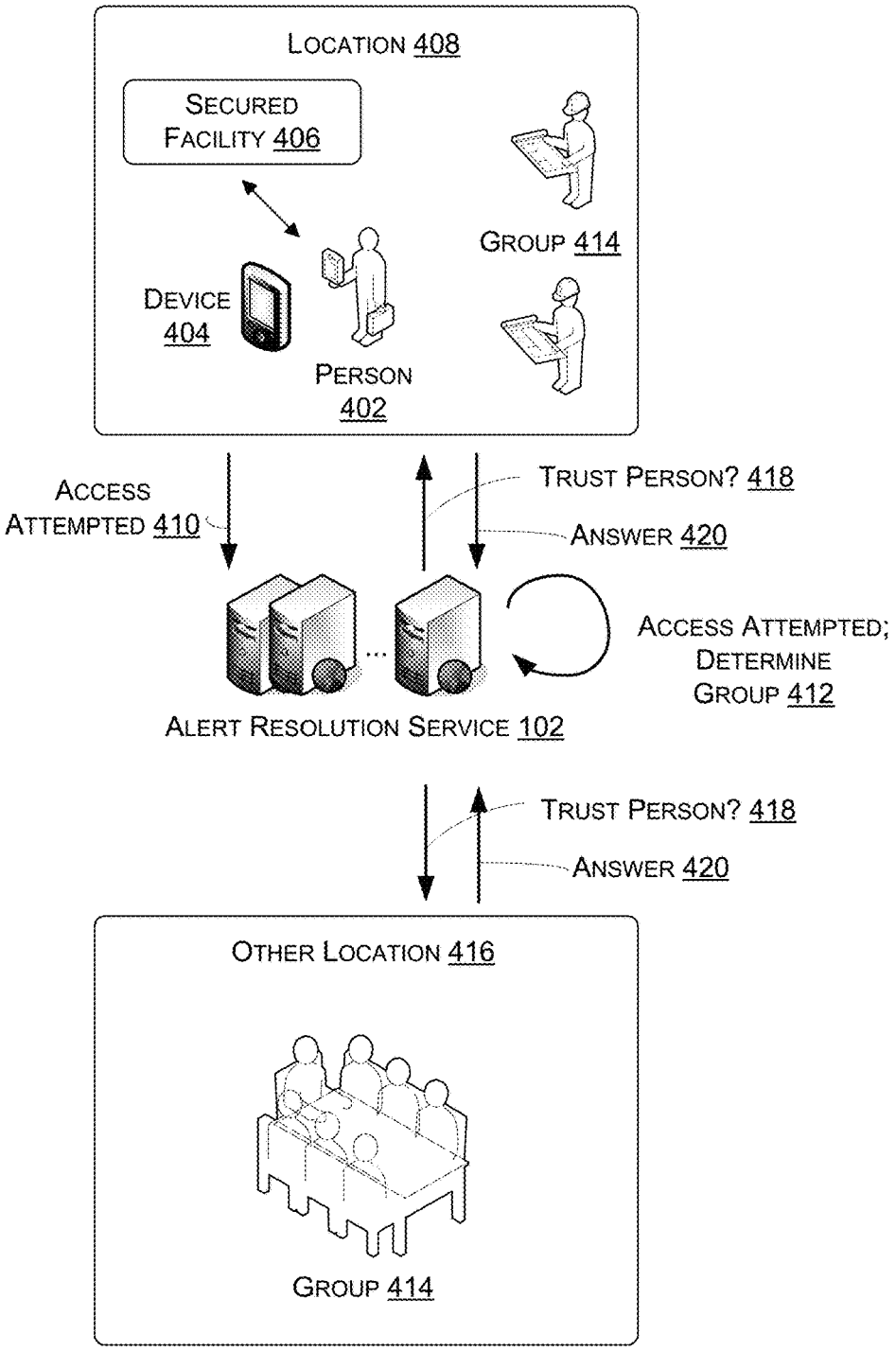
FIG. 4 illustrates an example scenario in which a device of a person requests access to a physical location or seeks a security permission and other persons or devices are contacted to validate the identity of the person.

FIG. 4 illustrates an example scenario in which a device of a person requests access to a physical location or seeks a security permission and other persons or devices are contacted to validate the identity of the person. As illustrated, a person 402 with a device 404 may be attempting to access a secured facility 406 at a location 408. The device 404 or another device associated with the secured facility 406 may report 410 the access attempt to the alert resolution service 102. The alert resolution service 102 may determine 412 that the person 402 is attempting access for which that person 402 lacks appropriate credentials and may generate an alert. The alert resolution service 102 may then determine 412 a group 414 which includes persons 414 at the location 408 of the secured facility 406 and persons 414 at other location(s) 416. The alert resolution service 102 may then request 418 information from the group 414, asking whether the person 402 should be permitted to access the secured facility 406. The alert resolution service 102 may then receive 420 answers to those questions and take action based on the answers. In the illustrated example, the answers may indicate that the person 402 should be trusted to access the secured facility 206, which may lead the alert resolution service 102 to dismiss the alert.

Example Processes

Figure 5:
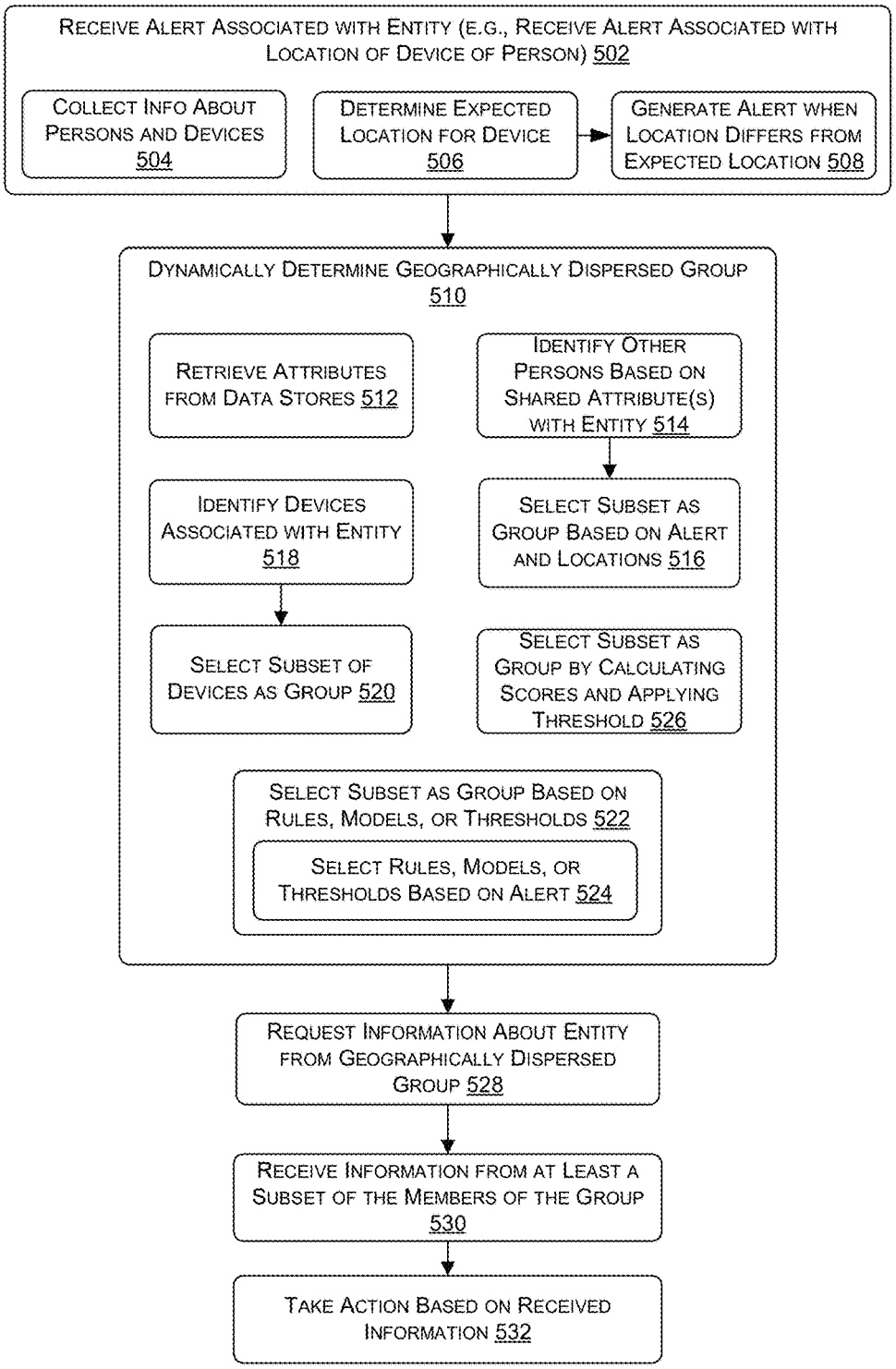
FIG. 5 illustrates a flow chart of an example process for dynamically determining a geographically dispersed group of persons sharing attributes with another person to resolve an alert associated with that other person.

FIG. 5 illustrates an example process. This process is illustrated as a logical flow graph, each operation of which represents a sequence of operations that can be implemented in hardware, software, or a combination thereof. In the context of software, the operations represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described operations can be combined in any order and/or in parallel to implement the processes.

FIG. 5 illustrates a flow chart of an example process for dynamically determining a geographically dispersed group of persons sharing attributes with another person to resolve an alert associated with that other person. The process may include, at 502, receiving, by one or more computing devices, an alert associated with an entity, such as an alert associated with a location of a device of a person.

At 504, the computing device(s) may collect information about a plurality of persons and from devices of those persons and store that information in one or more data stores as attributes of profiles for the persons. Such information may include, for example, GPS data. The data store(s) may be or include a store of a telecommunication service provider which includes attributes of service recipients of the telecommunication service provider. Also, attributes stored in the data store(s) may be updated in substantially real-time.

At 506, the computing device(s) may determine an expected location for the device based on one or more histories or behavior models for the person. At 508, the computing device(s) may generate the alert when a substantially real-time location of the device of the person differs from the expected location of the device. In some implementations, the alert may further be based on geographic proximity of the person to a specific other person, on security considerations associated with the substantially real-time location of the device, on multiple devices of the person being in different locations at a same time, or on a request by the person for some access or activity.

At 510, based on the alert and on substantially real-time attributes for the entity, the computing device(s) may dynamically determine a geographically dispersed group. Each member of the geographically dispersed group may either (i) be a device associated with the entity or (ii) share at least one attribute with the entity.

At 512, the dynamically determining may include retrieving the attributes from one or more data stores, such as the data store(s) for collecting information that were described above.

At 514, the dynamically determining may include identifying other persons from data profiles of each of the other persons. Each data profile may include the at least one attribute shared with the entity. At 516, the computing device(s) may then select a subset of the other persons as the members of the geographically dispersed group based at least in part on the alert and the location.

In some implementations, the attributes of at least one of the other persons include a last name of the at least one of the other persons, a home address of the at least one of the other persons, a work address of the at least one of the other persons, substantially real-time locations of a plurality of devices of the at least one of the other persons, an employer of the at least one of the other persons, a telecommunication service plan identifier of the at least one of the other persons, or a familial role of the at least one of the other persons.

In further implementations, the attributes of at least one of the other persons may include a last name of the at least one of the other persons, a home address of the at least one of the other persons, a work address of the at least one of the other persons, substantially real-time locations of a plurality of devices of the at least one of the other persons, an employer of the at least one of the other persons, a telecommunication service plan identifier of the at least one of the other persons, or a familial role of the at least one of the other persons.

At 518, instead of or in addition to identifying the other persons, the computing device(s) may identify the devices associated with the entity and, at 520, select at least a subset of the identified devices as members of the geographically dispersed group.

At 522, selecting the subset of other persons may include selecting the subset of the other persons as the members of the geographically dispersed group based on one or more rules, models, or confidence thresholds. At 524, the computing device(s) may select the rules, models, or confidence thresholds based on the alert, on circumstances associated with alert, or on the entity location.

At 526, selecting the subset of other persons may include, for each of the other persons, adding a point for each attribute in common with the person to calculate a score. The computing device(s) may then select as the subset of the other persons those other persons with scores exceeding a threshold.

At 528, the computing device(s) may request information about the entity from the geographically dispersed group. The information requested may vary based on circumstances associated with the alert. Further, requesting the information may comprise sending at least one of a text message, a multi-media message, an email, or placing a call.

At 530, the computing device(s) may receive the information from at least a subset of the geographically dispersed group.

At 532, the computing device(s) may take action responsive to the alert based on the received information. Taking action may comprise authorizing the person to have access, alerting the person that the device of the person has been stolen, alerting authorities regarding a location of the person, contacting a parent or guardian regarding the location of a person, disabling one or more features of the device of the person.

Example Devices

FIG. 6 illustrates an example system architecture of a computing device 600 configured to perform all or part of the dynamic determination of the geographically dispersed group. As illustrated, the computing device 600 comprises a system memory 602 storing one or more modules and data 604. Also, the computing device 600 includes processor(s) 606, a removable storage 608, a non-removable storage 610, input device(s) 612, output device(s) 614, and communication connections 616 to one or more other computing devices 618.

In various examples, system memory 602 may be volatile (such as RAM), non-volatile (such as ROM, flash memory, etc.) or some combination of the two. The modules and data 604 may represent any or all of the monitoring module 114, the data store 116, the alert module 118, the group determination module 120, or the alert resolution module 122. Additionally, the modules and data 604 may include any operating system or application components or data.

In some implementations, the processor(s) 604 is a central processing unit (CPU), a graphics processing unit (GPU), or both CPU and GPU, or any other sort of processing unit. Each of the one or more processor(s) 604 may have numerous arithmetic logic units (ALUs) that perform arithmetic and logical operations, as well as one or more control units (CUs) that extract instructions and stored content from processor cache memory, and then executes these instructions by calling on the ALUs, as necessary, during program execution. The processor(s) 204 may also be responsible for executing all computer applications stored in the memory 206, which can be associated with common types of volatile (RAM) and/or nonvolatile (ROM) memory.

The computing device 600 may also include additional data storage devices (removable and/or non-removable) such as, for example, magnetic disks, optical disks, or tape. Such additional storage is illustrated in FIG. 6 by removable storage 608 and non-removable storage 610.

Non-transitory computer-readable media may include volatile and nonvolatile, removable and non-removable tangible, physical media implemented in technology for storage of information, such as computer readable instructions, data structures, program modules, or other data. System memory 602, removable storage 608 and non-removable storage 610 are all examples of non-transitory computer-readable media. Non-transitory computer-readable media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible, physical medium which can be used to store the desired information and which can be accessed by the computing device 600. Any such non-transitory computer-readable media may be part of the computing device 600.

In various examples, input devices 612 may include any sort of input devices known in the art. For example, input devices 612 may include a camera, a microphone, a keyboard/keypad, or a touch-sensitive display. A keyboard/keypad may be a push button numeric dialing pad (such as on a typical telecommunication device), a multi-key keyboard (such as a conventional QWERTY keyboard), or one or more other types of keys or buttons, and may also include a joystick-like controller and/or designated navigation buttons, or the like.

In some examples, the output devices 614 may include any sort of output devices known in the art, such as a display (e.g., a liquid crystal display), speakers, a vibrating mechanism, or a tactile feedback mechanism. Output devices 614 may also include ports for one or more peripheral devices, such as headphones, peripheral speakers, or a peripheral display.

Computing device 600 also contains communication connections 616 that allow the computing device 600 to communicate with other computing devices 618, such as devices 108 or monitoring service 106. As described above with reference to FIG. 1, these communication connections 616 may be secured in accordance with one or more standards, protocols, specifications, or techniques to enable secure communication among the devices.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A method comprising:

receiving an alert associated with a first device of a first entity indicating that the first device of the first entity is within proximity to a second device of a second entity;

based on the alert and on substantially real-time attributes for the first entity, dynamically determining a geographically dispersed group, each member of the geographically dispersed group either (i) being at least one device associated with the first entity or (ii) sharing at least one attribute with the first entity;

requesting information about at least one of the first entity or the second entity from the geographically dispersed group;

receiving the information from at least a subset of the geographically dispersed group; and taking action responsive to the alert based on the information.

2. The method of claim 1, wherein the alert associated with the first device is generated when a substantially real-time location of the first device is within proximity to a substantially real-time location of the second device.

3. The method of claim 1, further comprising determining that the second entity comprises at least one of a predator or a non-custodial parent.

4. The method of claim 1, wherein the action comprises sending an alert to a third device associated with a third entity, the third entity comprising at least one of a parent of the first entity, a guardian of the first entity, or an authority.

5. The method of claim 1, wherein the dynamically determining includes identifying other persons from data profiles of each of the other persons, each data profile including the at least one attribute shared with the first entity, and selecting a subset of the other persons as members of the geographically dispersed group based at least in part on the alert.

6. The method of claim 5, wherein the dynamically determining alternatively or additionally includes identifying the at least one device associated with the first entity and selecting at least a subset of the at least one device as members of the geographically dispersed group.

7. The method of claim 5, wherein the at least one attribute includes a last name of the at least one of the other persons, a home address of the at least one of the other persons, a work address of the at least one of the other persons, substantially real-time locations of a plurality of devices of the at least one of the other persons, an employer of the at least one of the other persons, a telecommunication service plan identifier of the at least one of the other persons, or a familial role of the at least one of the other persons.

8. The method of claim 5, wherein the dynamically determining includes retrieving the at least one attribute from one or more data stores.

9. The method of claim 5, wherein selecting the subset includes selecting the subset of the other persons as members of the geographically dispersed group based on one or more rules, models, or confidence thresholds.

10. The method of claim 9, further comprising selecting the one or more rules, models, or confidence thresholds based on the alert, on circumstances associated with alert, or on a location of the first entity.

11. The method of claim 1, wherein dynamically determining the geographically dispersed group based on the alert and substantially real-time attributes for the first entity comprises dynamically determining the geographically dispersed group based on one or more rules or models associated with the alert, on information associated with circumstances that gave rise to the alert, or on the substantially real-time attributes for the first entity.

12. The method of claim 1, wherein the information requested varies based on circumstances associated with the alert.

13. One or more non-transitory computer-readable media having stored thereon programming instructions which, when executed by one or more computing devices, cause the one or more computing devices to perform operations comprising:

receiving an alert associated with a first device of a first entity indicating that the first device of the first entity is within proximity to a second device of a second entity;

dynamically determining a geographically dispersed group, including at least one of:

(i) identifying other persons from data profiles of each of the other persons, each data profile including at least one attribute in common with a data profile of the first entity, and selecting a subset of the other persons as members of the geographically dispersed group based at least in part on the alert, or (ii) determining identified devices associated with the first entity and selecting at least a subset of the identified devices as members of the geographically dispersed group;

requesting information about the first entity from the geographically dispersed group;

receiving the information from the geographically dispersed group; and taking action responsive to the alert based at least in part on the information.

14. The one or more non-transitory computer-readable media of claim 13, wherein selecting the subset of the other persons or identified devices comprises selecting the subset based on one or more rules, models, or confidence thresholds.

15. The one or more non-transitory computer-readable media of claim 13, wherein selecting the subset further comprises:

for each of the other persons, adding a point for each attribute in common with the first entity to calculate a score, and selecting as the subset of the other persons those other persons with scores exceeding a threshold.

16. The one or more non-transitory computer-readable media of claim 13, wherein requesting the information comprises sending at least one of a text message, a multimedia message, an email, or placing a call.

17. The one or more non-transitory computer-readable media of claim 13, wherein taking action comprises sending an alert to a third device associated with a third entity, the third entity comprising at least one of a parent of the first entity, a guardian of the first entity, or an authority.

18. A system comprising:

a processor;

a data store coupled to the processor and configured to store attributes of a plurality of persons;

an alert module configured to be operated by the processor to generate an alert indicating that a first device of a first entity is within proximity to a second device of a second entity;

a group determination module configured to be operated by the processor to dynamically determine a geographically dispersed group by performing at least one of:

(i) retrieving attributes from the data store, identifying other persons from the plurality of persons based at least on shared attributes, and selecting a subset of the other persons as members of the geographically dispersed group based at least in part on the alert, or (ii) determining identified devices associated with first entity and selecting at least a subset of the identified devices as members of the geographically dispersed group; and an alert resolution module configured to be operated by the processor to request information about the first entity from the geographically dispersed group, receive the information from the geographically dispersed group, and take action responsive to the alert based at least in part on the information.

19. The system of claim 18, wherein the group determination module is configured to select the subset based on one or more rules, models, or confidence thresholds.

20. The system of claim 18, wherein the data store is a store of a telecommunication service provider which includes attributes of service recipients of the telecommunication service provider.

* * * * *